United States Patent [19]

Washington

[11] 4,287,701

[45] Sep. 8, 1981

[54] SACK BAG HOLDER

[76] Inventor: Raymond J. Washington, 300 Terry Dr., Lafayette, La. 70501

[21] Appl. No.: 63,405

[22] Filed: Aug. 3, 1979

[51] Int. Cl.[3] ..... B65B 67/12

[52] U.S. Cl. ..... 53/390; 248/99

[58] Field of Search ..... 248/99, 100, 101; 141/390; 53/390, 469, 459, 384

[56] References Cited

U.S. PATENT DOCUMENTS

| | | | |
|---|---|---|---|
| 1,868,269 | 7/1932 | Beadle | 248/101 X |
| 3,614,041 | 10/1971 | Koger | 248/101 X |
| 3,817,448 | 6/1974 | Schneider | 248/99 X |
| 3,893,649 | 7/1975 | Cornell et al. | 248/99 |

*Primary Examiner*—Horace M. Culver

[57] ABSTRACT

A hoop mountable around a mouth of a large plastic bag to hold it open; such as when lawn clippings, fallen leaves and also other refuse such as garbage, old papers, etc., are placed therein. The hoop including two axially spaced apart circular rings connected together by a series of flat metal strips therebetween; each strip being arcuately bent inward toward a center of the hoop, thus forming a circular groove around the hoop for receiving a circular coil spring band therearound and holding the bag edge that is draped over the hoop; and a pull cord being attached to the band for pulling it off afterwards.

4 Claims, 4 Drawing Figures

SACK BAG HOLDER

SUMMARY OF THE INVENTION

This invention relates generally to gardening accessories. More specifically it relates to trash bags such as are being used for collecting leaves, grass clippings, garden trash and other refuse.

It is well known that when large quantities of various garden debris is attempted by a person working alone to be placed in a collapsed mouth of a refuse bag, it is difficult to keep the mouth fully open, due to high wind, etc. Therefore, most of the debris falls out on the ground instead. Accordingly this situation is in need of an improvement.

Therefore, it is a principal object of the present invention to provide a sack bag holder that keeps the bag or sack's mouth opened while quantities of refuse is being attempted to be placed therein.

Another object is to provide a sack bag holder that can be quickly and easily fitted around a bag's mouth, and afterwards removed therefrom.

PREFERRED EMBODIMENT

Figure 1:
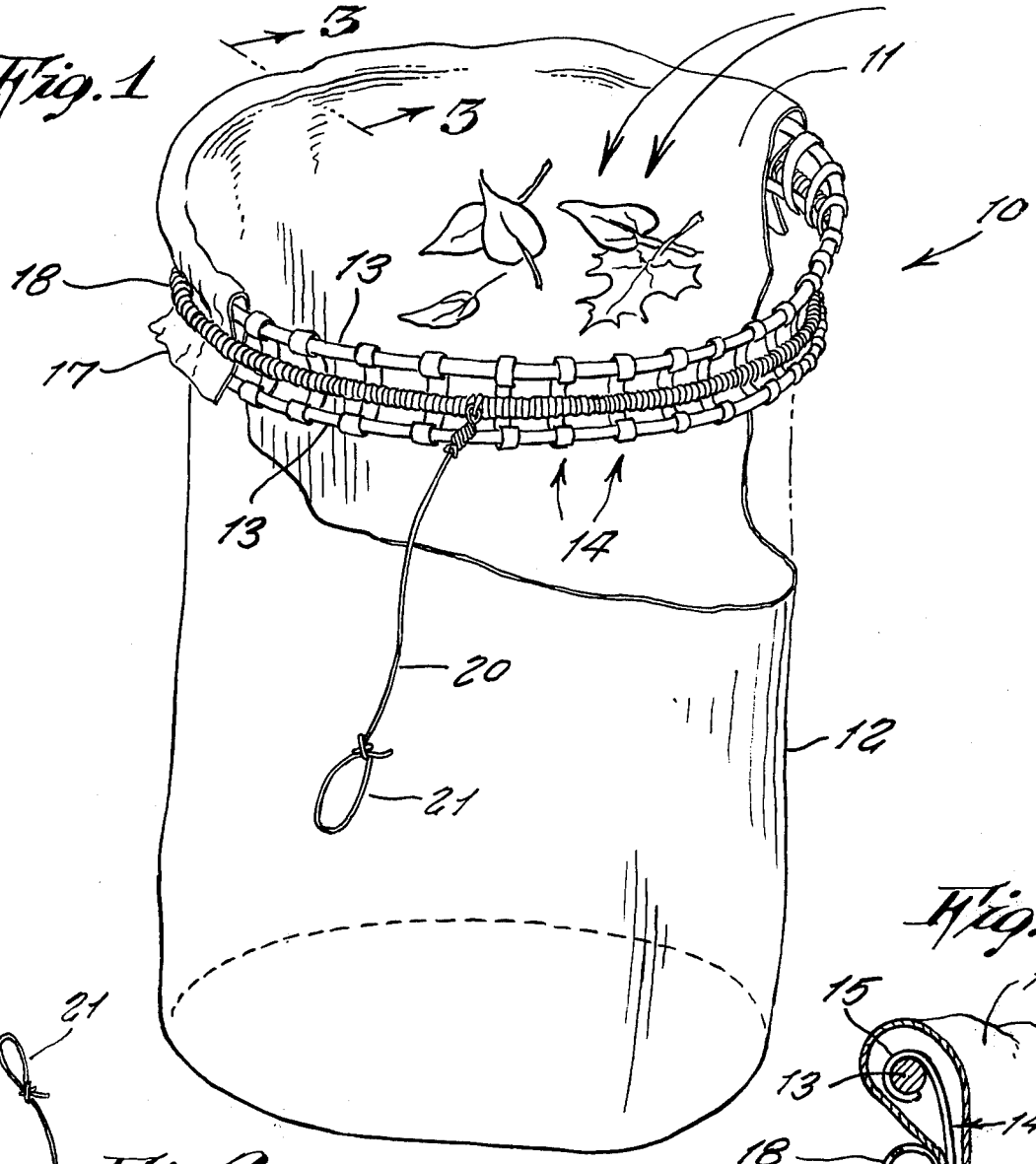
FIG. 1 is a perspective view of the invention shown holding a bag mouth open while raked leaves or grass is placed therein; the bag being illustrated partly broken away to show the invention fully.

Referring now to the invention in greater detail. The reference numeral 10 represents a Sack Bag Holder according to the present invention for the intended purpose of being installed around a mouth 11 or a bag or sack 12 in order to keep the mouth in an open position.

The bag or sack maybe of any large kind; being made either of woven gunny sack jute, or else a cheap conventional type thin plastic bag, such as maybe disposed along with the rubbish.

The holder comprises an assembled hoop made with two circular metal rings 13 of approximately 19 inches diameter. The rings are axially spaced apart and held together by a plurality of flat metal strips 14 therebetween, which at each opposite end 15, is rolled over in order to grasp the ring. An intermediate portion between the rolled over ends is arcuately bent towards a center of the hoop as shown 16. The strips are spaced one and one-half inches apart.

The device maybe painted in any varities of attractive colors, so to be easily found wherever placed.

Figure 3:
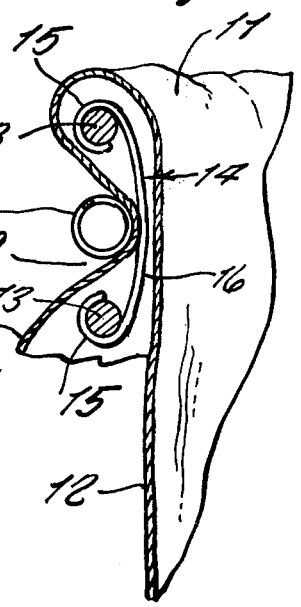
FIG. 3 is an enlarged cross-sectional view taken on line 3—3 of FIG. 1.
Figure 2:
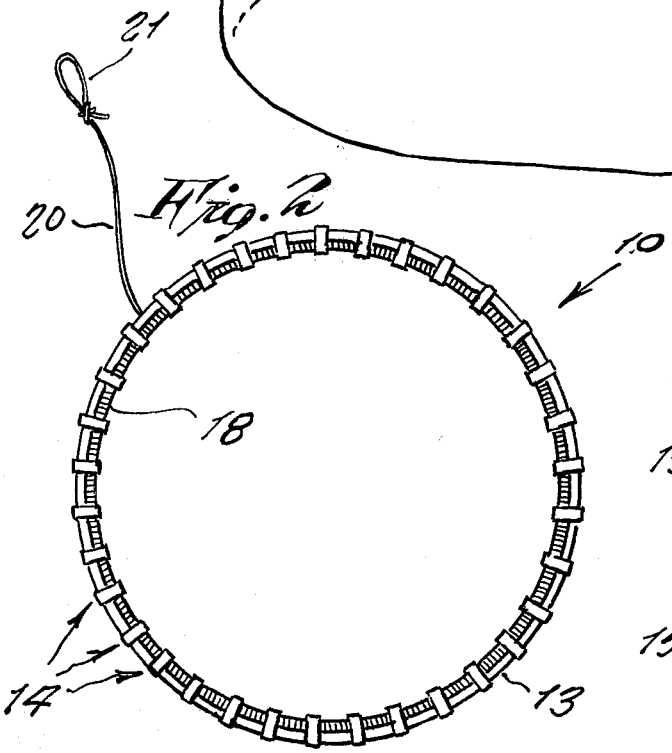
FIG. 2 is a top view of the invention shown alone.
Figure 4:
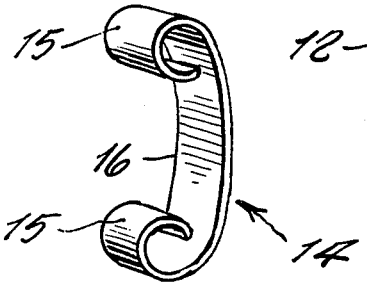
FIG. 4 is a perspective view of one of the metal tabs which at each end is looped around the two circular rings.

In use the bag is placed inside the hoop and the bag lip or edge 17 around the mouth 11, and is then allowed to drape down around an outer side of the loop as shown on FIGS. 1 and 3.

And endless band 18 made from coiled tension springs is then snap fitted into a groove 19, formed on the outer side of the hoop between the rings; the band firmly retaining the draped over bag edge 17 against arcuately con-curved side of the strips as shown.

A nylon pull cord 20 attached at one end to the band has a loop 21 at it's other end for convenient grasping when the band is to be pulled off the hoop again at such time when the holder is to be removed from the sack or bag.

It is understood that construction variations maybe made on this invention which are within the limits of the following claims.

I claim:

1. A sack holder comprising in combination:

a. a hoop-like assembly with a pair of circular metal rings, axially aligned and spaced apart;

b. a plurality of flat metal strips between said rings, and maintaining said rings spaced apart, a removable coiled tension spring band placed around an outer side of said plurality of strips, and means for removal of said removable tension coiled band from said hoop-like assembly.

2. The apparatus in claim 1, wherein each opposite end of said strips is rolled over around each of said circular metal rings.

3. The apparatus in claim 2, wherein a groove is formed on an outer side of said plurality of strips, said groove receiving said band.

4. A sack bag holder comprising:

a. a pair of circular metal rings, axially aligned and spaced apart, forming a hoop-like assembly;

b. a plurality of flat metal strips, each of said opposite ends of said metal strips rolled over around each of said rings, forming a groove between said ring;

c. a removable coiled tension spring band placeable around an outer side of said plurality of strips, said band conforming substantially to the outer side of said strips;

d. a cord attached at a first end to said band, so that when said cord is pulled, said band is removed from said metal hoop-like assembly.

* * * * *